US007113025B2

(12) United States Patent
Washburn

(10) Patent No.: US 7,113,025 B2
(45) Date of Patent: Sep. 26, 2006

(54) LOW-VOLTAGE BANDGAP VOLTAGE REFERENCE CIRCUIT

(75) Inventor: Clyde Washburn, Victor, NY (US)

(73) Assignee: Raum Technology Corp., Rochester, NY (US)

( * ) Notice: Subject to any disclaimer, the term of this patent is extended or adjusted under 35 U.S.C. 154(b) by 9 days.

(21) Appl. No.: 10/886,792

(22) Filed: Jul. 7, 2004

(65) Prior Publication Data

US 2005/0231270 A1 Oct. 20, 2005

Related U.S. Application Data

(60) Provisional application No. 60/562,843, filed on Apr. 16, 2004.

(51) Int. Cl.
*G05F 1/10* (2006.01)

(52) U.S. Cl. ..... 327/539; 327/541; 323/313; 323/315

(58) Field of Classification Search ..... 327/539, 327/540, 541; 323/313, 315
See application file for complete search history.

(56) References Cited

U.S. PATENT DOCUMENTS 6,677,808 B1 1/2004 Sean et al.
6,853,238 B1 * 2/2005 Dempsey et al. ..... 327/539
6,894,544 B1 * 5/2005 Gubbins ..... 327/143
6,906,581 B1 * 6/2005 Kang et al. ..... 327/539
6,930,538 B1 * 8/2005 Chatal ..... 327/539
6,958,643 B1 * 10/2005 Rosenthal ..... 327/540
2002/0093325 A1 7/2002 Ju
2003/0006747 A1 1/2003 Jaussi et al.
2003/0038672 A1 * 2/2003 Buckley, III et al. ..... 327/539
2003/0107360 A1 6/2003 Gheorghe et al.
2003/0201822 A1 10/2003 Kang et al.
2004/0124822 A1 * 7/2004 Marinca ..... 323/313
2004/0155700 A1 * 8/2004 Gower et al. ..... 327/543
2005/0073290 A1 * 4/2005 Marinca et al. ..... 323/907
2005/0110476 A1 * 5/2005 Mukherjee et al. ..... 323/313
2005/0151528 A1 * 7/2005 Marinca ..... 323/316

* cited by examiner

*Primary Examiner*—Terry D. Cunningham
(74) *Attorney, Agent, or Firm*—Thomas R. FitzGerald, Esq.; Hiscock & Barclay, LLP

(57) ABSTRACT

A bandgap reference voltage generating circuit includes a proportional to absolute temperature (PTAT) voltage generating means generating a PTAT voltage. A complementary to absolute temperature (CTAT) voltage generating means generates a CTAT voltage. A temperature coefficient determining means interconnects the PTAT voltage generating means and the CTAT voltage generating means.

5 Claims, 6 Drawing Sheets

LOW-VOLTAGE BANDGAP VOLTAGE REFERENCE CIRCUIT

CROSS-REFERENCE TO RELATED APPLICATIONS

This application claims the benefit of U.S. Provisional Patent Application No. 60/562,843, filed 16 Apr. 2004.

TECHNICAL FIELD

The present invention relates to bandgap voltage reference circuits.

BACKGROUND

Bandgap voltage reference circuits generate a reference voltage that is relatively stable over a wide temperature range by balancing a voltage having a negative temperature coefficient (TC) and which is thus complementary to absolute temperature (CTAT) with a voltage having a positive temperature coefficient (TC) and which is thus proportional to absolute temperature (PTAT). Typically, the forward-biased p-n junction of a diode or the forward-biased base-to-emitter junction of a transistor provides the CTAT voltage, and the thermal voltage of a diode or transistor provides the PTAT voltage. Generally, the two voltages are scaled or voltage-divided as necessary and summed to produce the temperature-stable reference voltage.

The above-described concept is schematically and graphically depicted in FIG. 1, wherein it is shown that the base-to-emitter voltage $V_{BE}$ of a transistor T, having a temperature coefficient (TC) of approximately negative 2 millivolts (mV) per degree Celsius, is summed with the thermal voltage $V_t$ of a transistor which is scaled by factor K. The result is a reference voltage $V_{REF}$ that is equal to $V_{BE}$ plus the product of a scaling constant K and the thermal voltage $V_t$. Typically, $V_{REF}$ is from about 1.2 to 1.3 V depending on the particular technology of the components, and is close to the theoretical bandgap of Silicon at 0 K.

The continued trend toward producing ever smaller and more portable electronic devices requires that power consumption be reduced in order to increase battery life. In order to reduce power consumption, the supply, operating, and reference voltages supplied to and used by the circuitry within such devices must also be reduced. However, it is difficult to further reduce supply and reference voltages since typical bandgap voltage reference circuits provide a minimum reference voltage $V_{REF}$ of about 1.2 to 1.3 V and therefore require a supply voltage of at least approximately 1.4 V (one drain-source voltage drop higher than the reference voltage).

Some bandgap circuits that do provide reference voltages of less than 1.2V use an approach commonly referred to as fractional $V_{BE}$, wherein a fraction of the CTAT voltage drop across a base-to-emitter p-n junction is derived, typically via voltage division. A scaled PTAT voltage which is derived from a PTAT current is added to the CTAT fractional $V_{BE}$ to thereby produce a voltage that is relatively stable across a wide temperature range. The bandgap voltage reference circuits that use the fractional $V_{BE}$ approach, however, require additional voltage-dividing circuitry, such as resistors, that undesirably consume relatively large amounts of real estate on integrated circuit chips and raise power consumption.

Therefore, what is needed in the art is a bandgap voltage reference circuit that produces a reference voltage of less than 1.2 Volts.

Furthermore, what is needed in the art is a bandgap voltage reference circuit that operates with a reduced minimum supply voltage and thereby consumes less energy.

Moreover, what is needed in the art is a bandgap voltage reference circuit that provides a reference voltage of less than 1.2 Volts without the disadvantages of the fractional $V_{BE}$ approach.

SUMMARY OF THE INVENTION

The present invention provides a low-voltage bandgap reference voltage generating circuit.

The present invention comprises, in one form thereof, a proportional to absolute temperature (PTAT) voltage generating means generating a PTAT voltage and a complementary to absolute temperature (CTAT) voltage generating means generating a CTAT voltage. A temperature coefficient determining means interconnects the PTAT voltage generating means with the CTAT voltage generating means.

An advantage of the present invention is that a reference voltage of less than approximately 1.2 Volts is generated without the disadvantages of the fractional $V_{BE}$ approach.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
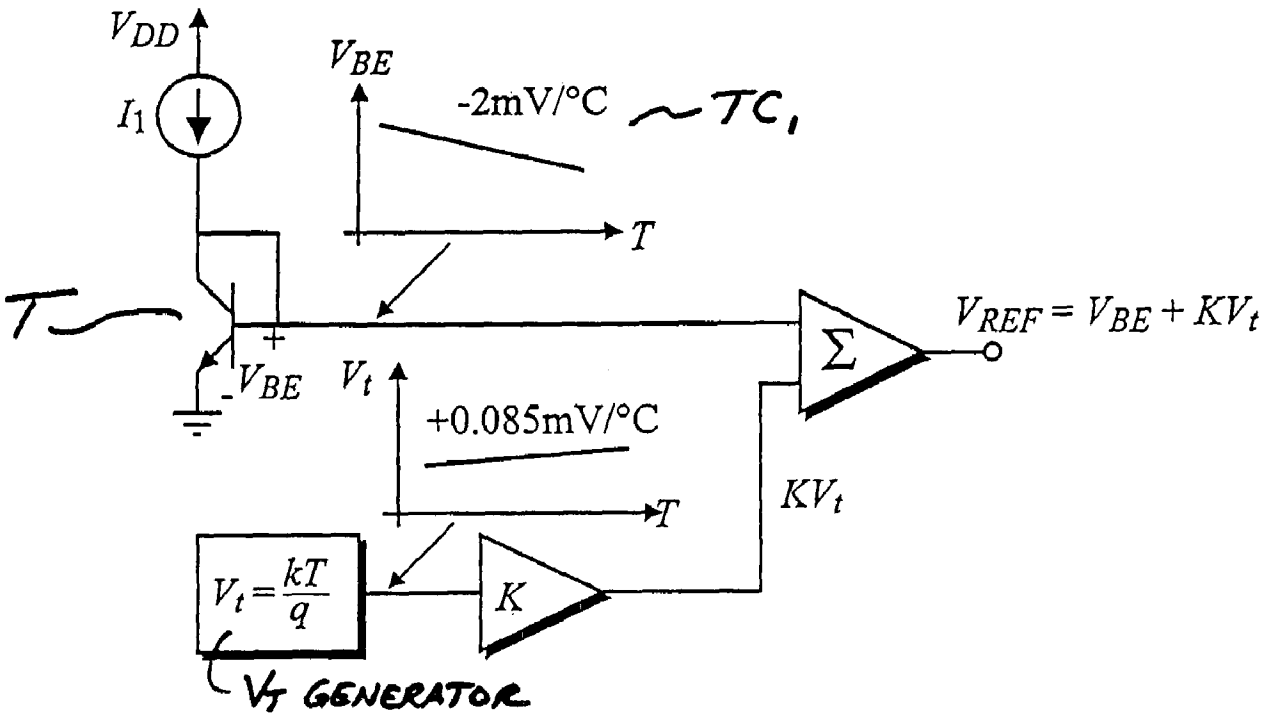
FIG. 1 PRIOR ART
FIG. 1 is a block diagram illustrating the operational principles of a typical bandgap voltage reference circuit.

Referring now to the drawings and particularly to FIG. 1, a block diagram that illustrates the operational principles of a conventional bandgap voltage reference circuit is shown. Transistor T has a base-to-emitter voltage $V_{BE}$ with a typical temperature coefficient (TC) of approximately negative 2 millivolts (mV) per degree Celsius, shown in plot $TC_1$. The $V_{BE}$ TC produces a $V_{BE}$ voltage that is CTAT. Thermal voltage $V_t$ is generated by $V_t$ generator and is scaled by scaling factor K. Thermal voltage $V_t$ has a TC of approximately +0.085 mV per degree Celsius, which is scaled by scaling factor K to a TC of approximately +2 mV per degree Celsius. Scaled thermal voltage $KV_t$ is PTAT and similar in magnitude to $V_{BE}$. Thus, when $V_{BE}$ and scaled thermal voltage $KV_t$ are summed by summing circuit Σ their TC's cancel each other and a temperature-stable reference voltage $V_{REF}$ of approximately 1.2 to 1.3 V results.

Figure 6A:
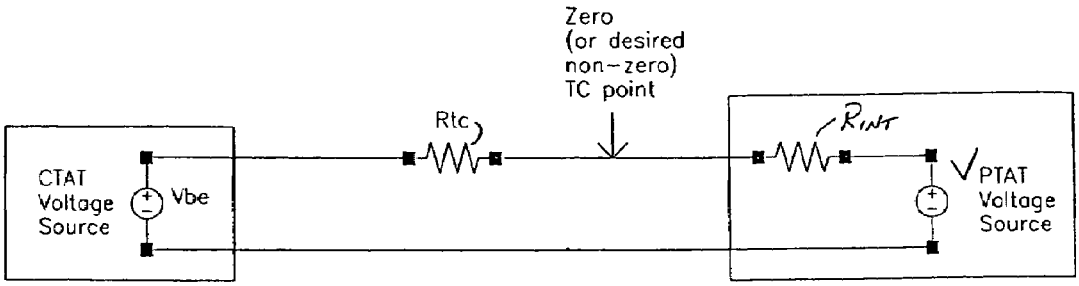
FIGS. 6A–6C are simplified schematic diagrams of low-voltage bandgap reference voltage circuits equivalent to those shown in FIGS. 2 and 3.

In contrast to the operational principles of conventional bandgap voltage reference circuits, the bandgap voltage reference circuit of the present invention, as best shown in FIG. 6A and described more particularly hereinafter, uses an undivided voltage drop across a forward-biased p-n junction to generate a CTAT voltage which is combined with a PTAT voltage by a temperature coefficient determining means, such as one or more resistor. An output voltage which is highly stable across variations in temperature and supply voltage is thus obtained.

Figure 2:
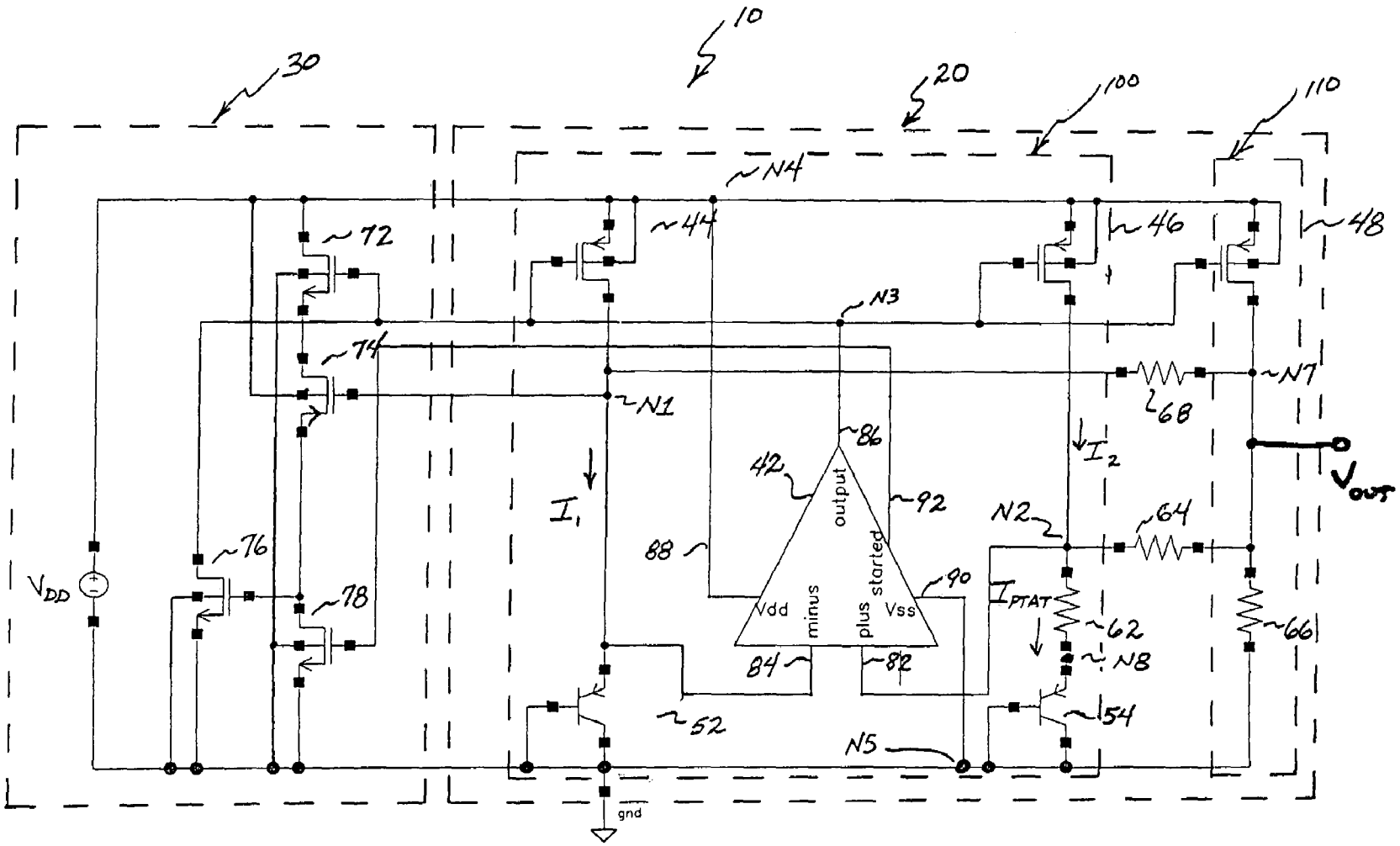
FIG. 2 is a schematic diagram showing one embodiment of a low-voltage bandgap reference voltage circuit of the present invention.

Referring now to FIG. 2, a schematic diagram of one embodiment of a low-voltage bandgap reference voltage circuit of the present invention is shown. Circuit 10 includes bandgap voltage reference circuit 20 and start-up circuit 30. Generally, bandgap circuit 20 includes an operational amplifier 42, metal oxide semiconductor transistors (MOSFETs) 44, 46 and 48, transistors 52 and 54, and resistors 62, 64, 66 and 68. Start-up circuit includes MOSFETs 72, 74, 76 and 78.

More particularly, operational amplifier (op-amp) 42 of bandgap circuit 20 includes positive and negative input terminals 82 and 84, respectively, output terminal 86, positive and negative supply terminals 88 and 90, and started output 92. Negative input terminal 84 is electrically connected to node N1, to which the emitter of transistor 52 and the drain of MOSFET 44 are connected. Positive input terminal 82 is electrically connected to node N2, to which resistors 62 and 64 and the drain of MOSFET 46 are each connected. Output 86 of op-amp 42 is electrically connected to node N3 to which the gates of MOSFETs 44, 46 and 48 are each connected. Positive and negative supply voltage inputs 88 and 90 of op-amp 42 are connected to nodes N4 and N5, respectively. Started output 92 is electrically connected to starter circuit 20 and is indicative, as will be more particularly described hereinafter, op-amp 42 is normally biased and operative.

Metal oxide semiconductor transistors (MOSFETs) 44, 46 and 48 are each configured as p-channel MOSFETS. MOSFET 44 has its source electrically connected to node N4, its gate electrically connected to node N3, and its drain electrically connected to node N1, to which the emitter of transistor 52 and starter circuit 20, as will be more particularly described hereinafter, are also electrically connected. MOSFET 46 has its source electrically connected to node N4, its gate electrically connected to node N3, and its drain electrically connected to node N2, to which resistors 62 and 64 and the positive input terminal 82 of op-amp 42 are also electrically connected. MOSFET 48 has its source electrically connected to node N4, its gate electrically connected to node N3, and its drain electrically connected to node N7, to which resistors 64 and 66 are also electrically connected. MOSFETs 44, 46 and 48 are each configured, and sometimes referred to hereinafter, as current mirrors.

Transistors 52 and 54 are configured as PNP transistors, each with their respective bases and collectors electrically tied or connected to node N5, which in turn is electrically connected to ground potential. Thus, transistors 52 and 54 are connected and function as diodes. Transistors 52 and 54 have effective emitter areas of a predetermined ratio and/or are operated with current densities of a predetermined ratio, such as, for example, a current density ratio of one to eight (current in transistor 52 relative to current in transistor 54). The collector of transistor 52 is electrically connected to node N1, to which the negative input terminal 84 of op-amp 42 is also electrically connected. The collector of transistor 54 is electrically connected to node N8, to which resistor 62 is also electrically connected.

Resistor 62 is electrically connected between nodes N2 and N8, resistor 64 is electrically connected between nodes N2 and N7, resistor 66 is electrically connected between nodes N7 and N5, and resistor 68 is electrically connected between nodes N1 and N7.

As discussed above, node N4 is electrically connected to supply voltage $V_{DD}$, and node N5 is electrically connected to ground potential.

In use, the operation of bandgap voltage reference circuit 20 is initialized by start-up circuit 30, which is more particularly described hereinafter. Once initialized, MOSFETs 44 and 46, which are configured as current mirrors, enter into conduction and provide substantially equal flows of current $I_1$ and $I_2$ through each of the current-density-ratioed transistors 52 and 54, respectively. The substantially equal flows of current $I_1$ and $I_2$ through current-density-ratioed transistors 52 and 54 develop respective base-to-emitter voltages across each of the diode-connected transistors.

Due to the different current densities flowing through transistors 52 and 54, the base-to-emitter voltage $V_{BE}$ developed across transistor 52 will be less than the $V_{BE}$ developed across transistor 54. A voltage that is equal to the difference between the base-to-emitter voltage across transistor 52 and the base-to-emitter voltage across transistor 54 appears across resistor 62, since the large closed-loop gain of op-amp 42 maintains its input terminals 82 and 84 at substantially equal voltages. Since the base-to-emitter voltages vary in a complementary manner with temperature, a PTAT current $I_{PTAT}$ that is proportional to absolute temperature flows through resistor 62.

Thus, op amp 42, diode-connected transistors 52 and 54 and resistor 62 form a PTAT current generating means generally designated 100 and enclosed in dashed lines in FIG. 2.

PTAT current $I_{PTAT}$ is applied by current-mirroring MOSFET 48 to resistor 66 and a voltage is developed across resistor 66 which is mirrored from the difference in the base-to-emitter voltages across the diode-connected transistors 52 and 54. Thus, current-mirroring MOSFET 48 and resistor 66, when coupled to PTAT current generating means 100, form a PTAT voltage generating means generally designated 110 and also enclosed in dashed lines in FIG. 2.

Figure 4:
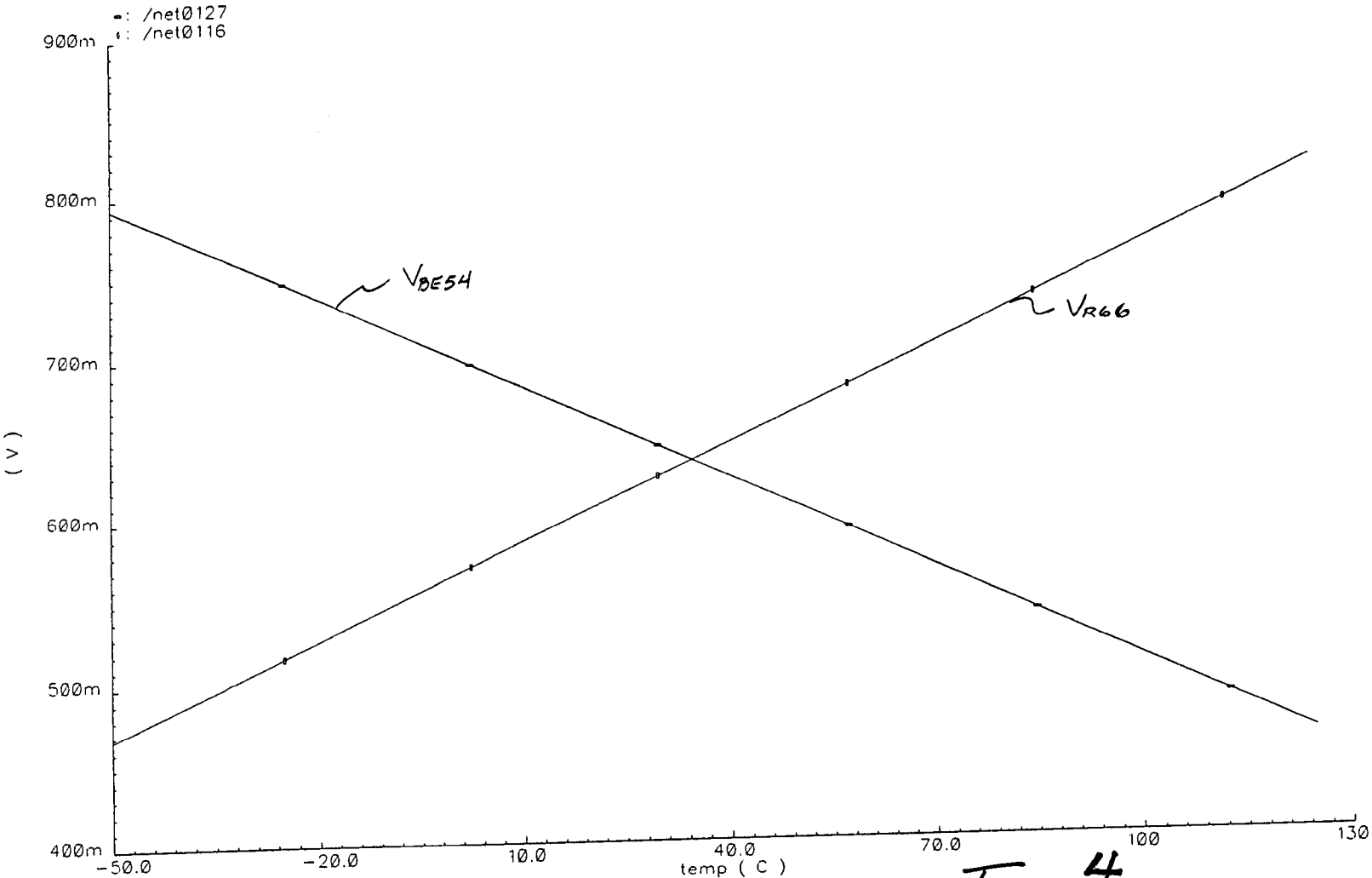
FIG. 4 is a plot of the reference voltages provided by the circuits of FIGS. 2 and 3 versus temperature.

As shown in FIG. 4, the base-to-emitter voltage of diode-connected transistor 54 is represented by curve $V_{BE54}$ and the voltage developed by the flow of the mirrored PTAT current through resistor 66 (in the absence of resistors 64 and 68) is represented by curve $V_{R66}$.

Referring to FIG. 6, the PTAT voltage generating means 110 of FIG. 2 is equivalent to a voltage generator $V_{PTAT}$ having an internal resistance $R_{INT}$ equal to the value of resistor 66 and generating an output voltage that is PTAT and equal to the product of $I_{PTAT}$ and the value of $R_{INT}$. It may also be said that the PTAT current generating means 100 of FIG. 2 is equivalent to a CTAT voltage source $V_{CTAT}$ having a source resistance of zero ohms, i.e., the ideal input resistance of op-amp 42.

Figure 6B:
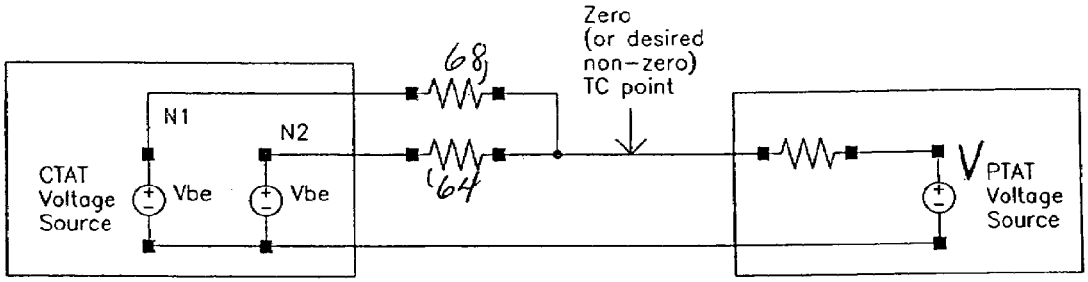
Figure 6C:
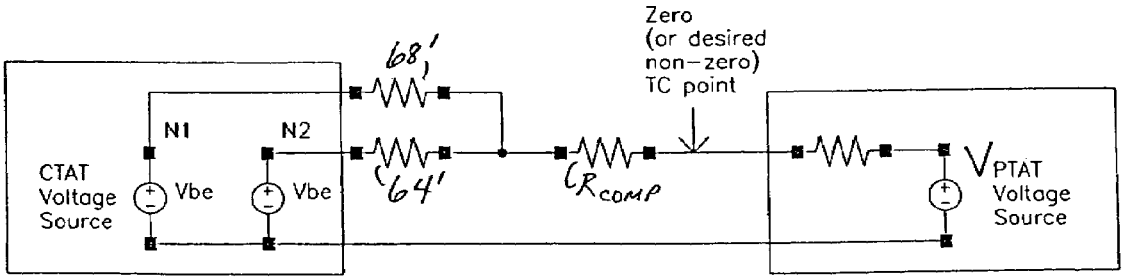

The equivalent parallel resistance value of parallel resistors 64 and 68, which are connected between nodes N1 and N7 and between nodes N2 and N7, respectively, determines the net temperature coefficient at node N7, which is the junction of the above-described voltage generator $V_{PTAT}$ and $V_{CTAT}$ shown in FIGS. 6A–6C, and is represented by resistor $R_{TC}$. Thus, a temperature coefficient with a desired value, such as, for example, zero or virtually any other desired value, is obtained through selection of the values of resistors 64 and 68. Resistors 64 and 68, interconnected as described hereinabove, thereby conjunctively form a temperature coefficient determining means (not referenced).

It should be noted that, in contrast to the bandgap circuits that use the partial $V_{BE}$ approach, bandgap circuit 20 uses the full base-to-emitter voltage drop across transistor 54, generates a comparable magnitude PTAT voltage, which is, by equivalency behind resistor 66, and determines the desired TC point (typically zero) between those two quantities by adjusting the values of a resistive voltage divider formed by resistor 66 and the parallel combination of resistors 64 and 68. It should also be particularly noted that resistors 64 and 68 share node N7 and are functionally in parallel. In practical implementations, and as shown in FIG. 6C, resistors 64 and 68 can be replaced by smaller-value resistor 64' and 68' and a third resistor $R_{COMP}$ in series with the parallel combination of resistors 64' and 68' and node N7 such that the total resistance from N1 and N2, seen in parallel, to N7 remains the unchanged.

Figure 5:
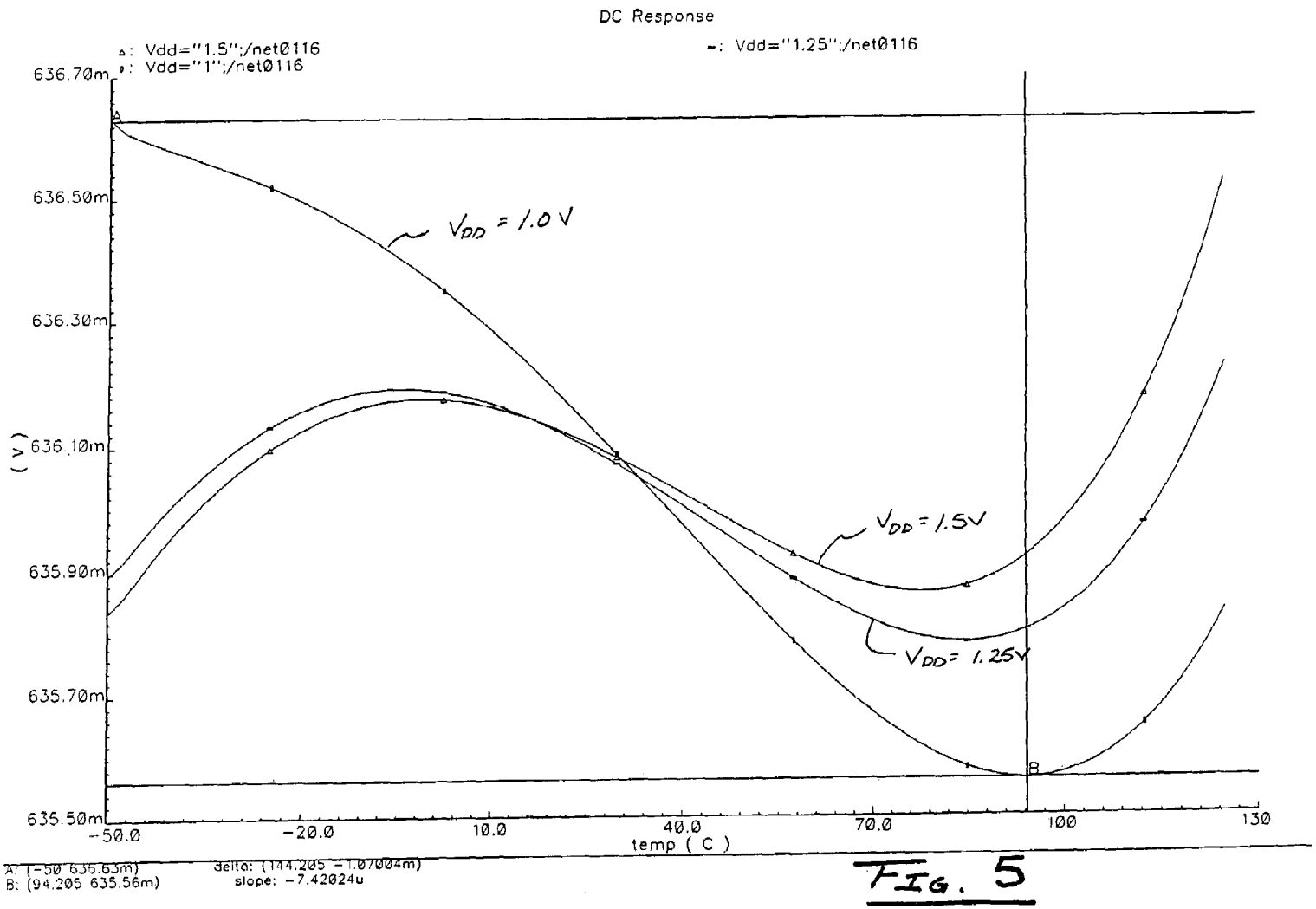
FIG. 5 is a plot of the reference voltage provided by the circuit of FIGS. 2 and 3 versus temperature as a function of supply voltage.

As shown in FIG. 5, the output voltage $V_{OUT}$ of bandgap circuit 20 is highly stable across variations in temperature and in supply voltage. More particularly, for a supply voltage $V_{DD}$ of approximately 1.0 Volts, output voltage $V_{OUT}$ varies a maximum of less than approximately 1.1 mV across an operating temperature range of approximately −55 to 125 Celsius. This relatively small variation improves, i.e., decreases, to a variation of less than approximately 0.3 mV as $V_{DD}$ increases from 1 to 1.25 and then to 1.5 Volts, as shown in FIG. 5.

Figure 3:
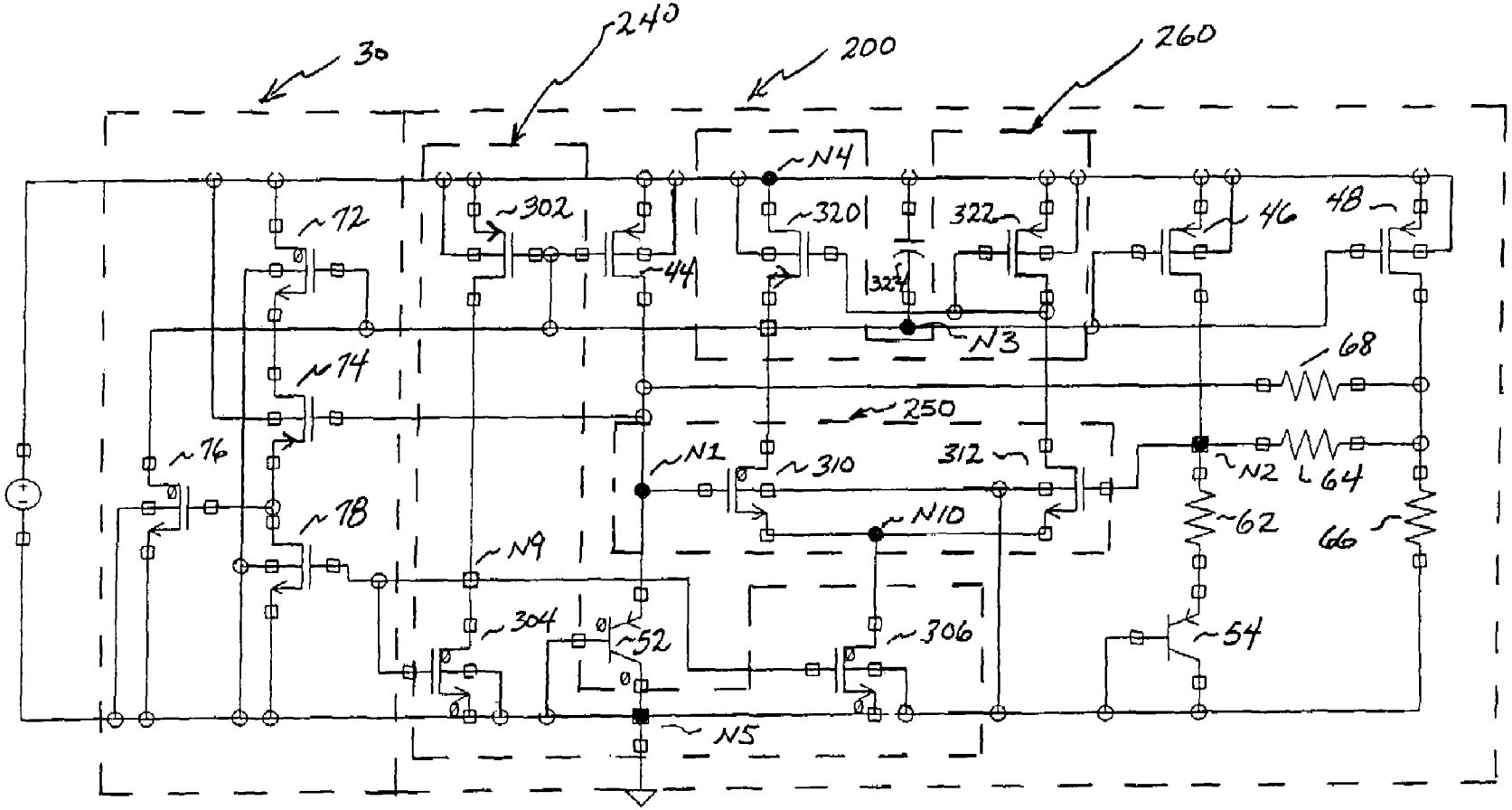
FIG. 3 is a schematic diagram showing a second embodiment of the low-voltage bandgap reference voltage circuit of the present invention.

Referring now to FIG. 3, a second embodiment of a bandgap voltage reference circuit of the present invention is shown. Bandgap voltage reference circuit 200, like bandgap circuit 20, includes start-up circuit 30. As is described more particularly hereainfter, bandgap voltage reference circuit 200 includes a current feedback loop 240, differential amplifier means 250, and active load 260, but is otherwise generally similar to bandgap circuit 20.

Current feedback loop 240 includes MOSFETS 302, 304 and 306. MOSFET 302 has its gate electrically connected to node N3, its source electrically connected to node N9 and its drain electrically connected to node N4. MOSFET 304 has its gate electrically connected to node N9, its source electrically connected to node N5 and its drain also electrically connected to node N9 and, thus, to the source of MOSFET 302. MOSFET 306 has its gate electrically connected to node N8, and thus to the source of MOSFET 302 and the drain of MOSFET 304, its source electrically connected to node N5 and its drain electrically connected to node N10. Current feedback loop 240 stabilizes or regulates the derived current in MOSFET 306 at a value twice the total current in MOSFET 322 and thereby causes there to be no offset across the gates of the differential pair composed of MOSFET 310 and 312 when they are providing equal currents to MOSFET 322 and mirror MOSFET 320 at equilibrium. $I_{PTAT}$ is thereby rendered strongly independent of supply voltage, as described above in regard to bandgap circuit 20.

Differential amplifier means 250 includes MOSFETS 310 and 312 electrically interconnected between node N9 and active load 260. More particularly, MOSFET 310 has its gate electrically connected to node N1, its source electrically connected to node N10 and its drain electrically connected to node N3. MOSFET 312 has its gate electrically connected to node N2, its source electrically connected to node N10 and its drain electrically connected to the drain of MOSFET 320 of active load 260. MOSFET 306 provides the tail current required for the operation of differential amplifier means 250.

Active load 260 includes MOSFETS 320 and 322. MOSFET 320 has its gate electrically connected to the gate and drain of MOSFET 322, its drain electrically connected to node N4 and its source electrically connected to node N3. MOSFET 322 has its gate electrically connected its drain, and to the gate of MOSFET 320 as just described, and its source electrically connected to node N4.

MOSFETS 310 and 312 of differential amplifier means 250 form an operational amplifier (shown generally as operational amplifier 42 in FIG. 2) operating at a tail current provided by MOSFET 306 of current feedback loop 240 and driving active load 260. MOSFETS 320 and 322 of active load 260, in turn, cause the current in MOSFETS 44 and 46 to maintain equal voltages across diode-connected transistor 52 and the combination of resistor 62 and diode-connected transistor 54 at nominal conditions, and thereby establish the PTAT current $I_{PTAT}$ in resistor 62.

The differential impedance across differential amplifier means 250 is the sum of the dynamic resistances of the diode-connected transistors 52 and 54 and resistor 62. Since the dynamic resistances of the diode-connected transistors 52 and 54 are approximately equal at any current, the differential amplifier means 250 is highly sensitive only to voltage changes across resistor 62 due to current change. Conversely, equal currents applied to the gates of MOSFETS 310 and 312 of differential amplifier means 250 are resisted by the full gain of the differential amplifier means 250, which acts to restore equilibrium and balance the voltages across diode-connected transistor 52 and the combination of resistor 62 and diode-connected transistor 54. This corrective action or gain is not significantly reduced so long as the source resistances of the disturbance currents are relatively large compared to the relatively small dynamic resistances of transistors 52 and 54 and resistor 62, and the disturbance currents are scaled in the same ratio as the currents of MOSFET mirrors 44 and 46. Accordingly, no significant change in the PTAT current $I_{PTAT}$ in resistor 62 occurs under such conditions. Resistors 64 and 68 act in parallel as a third resistor tied to the gates of MOSFETS 310 and 312 of differential amplifier means 250.

Referring again to FIG. 3, start-up circuit 30 includes MOSFETs 72, 74, 76 and 78. MOSFET 72 has its gate electrically connected to node N3, its source electrically connected to the drain of MOSFET 74, and its drain electrically connected to node N4. MOSFET 74 has its gate electrically connected to node N1, its source electrically connected to the drain of MOSFET 78, and its drain electrically connected to the source of MOSFET 72. MOSFET 76 has its gate electrically connected to the drain of MOSFET 78 and to the source of MOSFET 74, its source electrically connected to node N5, and its drain electrically connected to node N3. MOSFET 78 has its gate electrically connected to node N9, its drain electrically connected to the gate of MOSFET 76 and the source of MOSFET 74, and its source electrically connected to node N5. As previously noted, node N4 is electrically connected to supply voltage $V_{DD}$ and node N5 is electrically connected to ground potential.

In use, and in the absence of conduction in MOSFETS 44, 46 and 48, start-up circuit 30 initiates start-up of bandgap circuit 200 by initiating conduction in MOSFETS 72 and 74, which causes the gate of MOSFET 76 to rise toward one N-channel threshold voltage below the value of $V_{DD}$ due to MOSFET 72 being a diode-connected MOSFET with $V_{DD}$ applied to the drain and gate thereof when capacitor 324 has zero volts across its terminals and MOSFET 74 being biased into conduction by its gate being instantaneously coupled to ground potential with no conduction occurring in transistor 52. MOSFET 76 is therefore caused to conduct, which in turn quickly lowers the potential of the gates of P-channel current-mirroring MOSFETS 44, 46 and 48 downward from $V_{DD}$ toward ground potential as quickly as capacitor 324 permits. When MOSFETS 44, 46 and 48 enter into conduction, a forward-biasing gate voltage is applied to MOSFET 78 causing it to enter into conduction and short the gate of MOSFET 76 to node N5, i.e., ground potential, and thereby remove the start-up current and shutting down start-up circuit 30.

It should be noted that MOSFETS 72 and 74, which provide voltage to the gate of MOSFET 76, are connected such that their gates are connected to nodes N3 and N1, respectively, and thus have a reduced gate-to-source voltage after startup. The reduced gate-to-source voltage after start-up, in turn, reduces the power consumption of start-up circuit 30 during normal operation of band-gap circuit 20. More particularly, the gate of MOSFET 74 rises from ground potential to the forward-biased voltage of a silicon diode, while the gate of MOSFET 72 falls from supply voltage $V_{DD}$ to the gate-to-source voltage of the P-channel mirrors below $V_{DD}$. Since the sources of MOSFETS 72 and 74 are connected in series, the total gate-to-source voltage across the devices is appreciably reduced and, thereby, the current flowing through the devices is also reduced.

It should also be noted that the gate of transistor 74 can alternately be connected to the gate of transistor 312 rather than the gate of transistor 310, or the gate of transistor 304, depending on application requirements and/or preferences.

Capacitor 324 (FIG. 3) is an optional compensation capacitor for op-amp 42. It should be noted that the configuration shown in FIG. 3 is useful where capacitor 324 is formed from the gate of a FET, since the gate-to-source voltage of MOSFETS 44, 46 and 48 appears across the capacitor and a biased condition often produces a larger and more predictable value in such capacitors. In the case where capacitor 324 is configured as a type that functions adequately with zero nominal voltage across its terminals, such as, for example, a metal-insulator-metal type capacitor, then it may be advantageous to connect the capacitor as a Miller capacitor with one end on the gate and the other end on the drain of MOSFET 320.

In the embodiment shown, transistors 52 and 54 are disclosed as having effective emitter areas of a predetermined ratio and/or operate with current densities of a predetermined ratio, such as, for example, an effective emitter area ratio of one to eight. It is to be understood, however, that the present invention can be alternately configured with other ratios of effective emitter areas and/or current densities of transistor 52 relative to transistor 54, such as, for example, one to ten or other suitable ratios. Similarly, in the embodiment shown transistors 52 and 54 are provided with substantially equal flows of current I1 and I2 from current mirrors MOSFET 44 and 46. It is to be understood, however, that the present invention can be alternately configured with other ratios of current I1 and I2, such as, for example, eight to one or other suitable ratios, such that the current density ratio of transistor 52 relative to transistor 54 is as desired when they are equal in size, or some other combination of current ratio and transistor size ratio such that the desired current density ratio between transistors 52 and 54 is attained.

While the present invention has been described as having a preferred design, the invention can be further modified within the spirit and scope of this disclosure. This disclosure is therefore intended to encompass any equivalents to the structures and elements disclosed herein. Further, this disclosure is intended to encompass any variations, uses, or adaptations of the present invention that use the general principles disclosed herein. Moreover, this disclosure is intended to encompass any departures from the subject matter disclosed that come within the known or customary practice in the pertinent art and which fall within the limits of the appended claims.

What is claimed is:

1. A bandgap reference voltage generating circuit, comprising:

a proportional to absolute temperature (PTAT) voltage generating means generating a PTAT voltage;

a complementary to absolute temperature (CTAT) voltage generating means generating a CTAT voltage;

a temperature coefficient determining means interconnecting said PTAT voltage generating means and said CTAT voltage generating means;

wherein said CTAT voltage generating means comprises:

an op-amp configured for being powered by a supply voltage, said op-amp having inverting and noninverting op-amp inputs and an op-amp output;

a first CTAT voltage generating means generating a first CTAT voltage at said inverting op-amp input; and a second CTAT voltage generating means generating a second CTAT voltage at said noninverting op-amp input, said first and second CTAT voltages resulting from currents of a predetermined ratio in said first and second CTAT voltage generating means; and wherein said temperature coefficient determining means comprises:

a first resistor electrically interconnecting said first CTAT voltage generating means and an intermediate node;

a second resistor electrically interconnecting said second CTAT voltage generating means and said intermediate node; and a third resistor interconnecting said intermediate node and said PTAT voltage source.

2. A bandgap reference voltage generating circuit, comprising:

an op-amp configured for being powered by a supply voltage, said op-amp having inverting and noninverting op-amp inputs and an op-amp output;

a first device having at least one p-n junction electrically connected between said inverting input and ground potential;

a first resistor and a second device having at least one second p-n junction electrically connected between said noninverting input and ground potential, said at least one second p-n junction of said second device having a cumulative current density flowing therethrough that is a predetermined ratio smaller than a cumulative current density flowing through said at least one first p-n junction;

a PTAT voltage generating means including a current mirroring device electrically connected to said op-amp output and mirroring a PTAT current received therefrom, a second resistor electrically connected to said current mirroring device, said PTAT current flowing through said second resistor and developing a PTAT voltage;

a first temperature-coefficient (TC) determining resistor electrically interconnecting said inverting input of said op-amp to a node intermediate said current mirroring device and said second resistor connected thereto; and a second TC determining resistor electrically interconnecting said noninverting input of said op-amp to said node.

3. A bandgap reference voltage generating circuit, comprising:

a first and second MOSFET configured as a differential amplifier having first and second inputs;

a first device having at least one p-n junction electrically connected between said first input of said differential amplifier and ground potential;

a first resistor and a second device having at least one p-n junction electrically connected between said second input of said differential amplifier and ground potential, said at least one second p-n junction of said second device having a cumulative current density flowing there through that is a predetermined ratio smaller than a cumulative current density flowing through said at least one first p-n junction;

a PTAT voltage generating means electrically interconnected with a drain of said first MOSFET of said differential pair, said PTAT voltage generating means including a current mirroring device mirroring a PTAT current flowing through said second device, a second resistor electrically connected to said current mirroring device, said PTAT current flowing through said second resistor and developing a PTAT voltage;

a first temperature-coefficient (TC) determining resistor electrically interconnecting said second input of said differential amplifier to a node intermediate said current mirroring device and said second resistor connected thereto; and a second TC determining resistor electrically interconnecting said second input of said differential amplifier to said node.

4. The bandgap reference voltage generating circuit of claim 3, further comprising a current feedback loop including third, fourth and fifth current feedback MOSFETS substantially reducing any voltage offset across the inputs the differential amplifier at equilibrium.

5. The bandgap reference voltage generating circuit of claim 3, further comprising a start-up circuit, said start-up circuit including:

first, second and fourth start-up MOSFETs configured for being electrically interconnected between a supply voltage and ground potential, said first start-up MOSFET configured for having its drain electrically connected to said supply voltage, its gate electrically connected to the drain of said first MOSFET of said differential amplifier, and its source electrically connected to a drain of said second start-up MOSFET, a gate of said second start-up MOSFET electrically connected to said gate of said first MOSFET of said differential amplifier, and a source of said second start-up MOSFET electrically connected to a drain of said fourth start-up MOSFET, a gate of said fourth start-up MOSFET being electrically connected to said current feedback loop, a source of said fourth start-up MOSFET being electrically connected to ground potential; and a third start-up MOSFET having its gate electrically connected to the drain of said fourth start-up MOSFET and the source of said second start-up MOSFET, its source electrically connected to ground potential, and its drain electrically connected to the drain of said first MOSFET of said differential amplifier.

* * * * *